United States Patent [19]

Hercher

[11] Patent Number: 4,487,179

[45] Date of Patent: Dec. 11, 1984

[54] INTERNAL COMBUSTION ENGINE

[76] Inventor: Leroy E. Hercher, 311 Meridian Ave., San Jose, Calif. 95126

[21] Appl. No.: 436,835

[22] Filed: Jan. 3, 1983

[51] Int. Cl.[3] ..... F02F 3/24

[52] U.S. Cl. ..... 123/307; 123/316; 123/193 P

[58] Field of Search ..... 123/193 R, 193 P, 316, 123/660, 279, 286, 289, 291, 306, 307

[56] References Cited

U.S. PATENT DOCUMENTS

| | | | |
|---|---|---|---|
| 1,610,888 | 12/1926 | Sauer | 123/316 |
| 2,738,782 | 3/1956 | Bodine | 123/660 |
| 3,335,643 | 8/1967 | Wentworth | 123/193 P |
| 4,060,059 | 11/1977 | Blaser | 123/193 P |
| 4,154,207 | 5/1979 | Brehob | 123/193 P |
| 4,192,265 | 3/1980 | Amano et al. | 123/316 |

FOREIGN PATENT DOCUMENTS

| | | | |
|---|---|---|---|
| 54-42505 | 4/1979 | Japan | 123/193 P |

*Primary Examiner*—Craig R. Feinberg
*Attorney, Agent, or Firm*—I. Robert Mednick

[57] ABSTRACT

The internal combustion engine includes a cylinder block and a cylinder head forming a plurality of cylinders with a piston in each cylinder, a camshaft to open and close intake and exhaust ports, and a crankshaft to enable the piston to move back and forth in a reciprocating motion, wherein the piston is formed with a plurality of passageways extending from spaced inlets around its circumferential edge towards spaced outlets around the center of the piston head, and wherein the actuating means for the camshaft opens the exhaust port of each cylinder before the end of the power stroke. The internal combustion engine runs with a four stroke cycle of operation, but develops a power stroke divided into two phases. During the first phase of the power stroke, the combustible fluid mixture in the variable volume chamber of each cylinder is ignited to develop power and move the piston due to the expansion of the fluid mixture in a closed chamber. During the second phase of the power stroke, the fluid mixture flowing through the passageway forms an escaping column of burning fluid mixture extending from the center of the piston head towards the exhaust port to develop a reaction force on the piston head to continue the power stroke.

12 Claims, 9 Drawing Figures

INTERNAL COMBUSTION ENGINE

FIELD OF THE INVENTION

The invention relates to an internal combustion engine of the type where combustion of a fluid mixture in a chamber is initiated to develop power and move a piston during a power stroke of a four stroke cycle of operation.

DESCRIPTION OF THE PRIOR ART

The conventional automobile engine is an internal combustion engine that utilizes pistons inside cylinders operating on a four stroke cycle. The pistons are joined to a common crankshaft by connecting rods, so that the pistons travel back and forth in the cylinders in a reciprocating action as the crankchaft rotates. In the four stroke cycle engine, there is usually an exhaust valve and an intake valve for each cylinder. The valves are operated by a camshaft that is geared or otherwise connected to rotate at a fixed speed with respect to that of the crankshaft, e.g. at half the speed. The four strokes of each cycle of operation of this internal combustion engine are the intake, compression, power, and exhaust strokes, in the order stated. A fluid mixture of air and gasoline is drawn into each cylinder during the intake stroke, compressed during the compression stroke, ignited at the beginning of the power stroke to expand and move the piston during the power stroke, and then the burned fluid mixture is expelled during the exhaust stroke.

Another well known form of engine to produce propelling force is that of the jet engine. In a vehicle using such an engine, hot gases from a burning fluid mixture are ejected to develop a reaction force that pushes the vehicle in the direction of the reacting force while the burning fluid mixture is being ejected.

The operation of the conventional automobile internal combustion engine releases certain gases into the atmosphere which, in sufficient quantity and under certain atmosphere conditions, are harmful, and are referred to as air pollutants. The principal pollutants are carbon monoxides, hydrocarbons, and oxides of nitrogen. An effective method of reducing such pollutant exhausts is to provide a more efficient burning or combustion of the fluid mixture during the operation of the internal combustion engine. Additionally, the more efficient burning or combustion of the fluid mixture would also result in developing more usable power from the operation of the internal combustion engine.

SUMMARY OF THE INVENTION

The internal combustion engine of this invention runs with a four stroke cycle of operation, but develops a power stroke divided into two phases. As in the conventional internal combustion engine, during the first phase of each power stroke, the combustible fluid mixture in each cylinder is ignited to develop power and move the piston due to the expansion of the fluid mixture in a closed chamber. However, during the second phase of the power stroke, the fluid mixture continues to burn, but is ejected from the chamber through its exhaust port in order to develop a reaction force on the piston to continue the power stroke.

In order to effectively develop the reaction force on the piston, a column of burning fluid mixture extending from the center of the piston head is formed during the second phase of the power stroke. The piston in the engine of the present invention includes passageways extending from spaced inlets around its circumferential edge towards spaced outlets around the center of the piston head. The camshaft of the engine opens the exhaust port at the end of the first phase of the power stroke. Thereupon the burning fluid mixture in the chamber is caused to flow through the passageways to form an ejecting column extending from the center of the piston head towards the exhaust port. The developed reaction force on the piston head continues to move the piston and turn the crankshaft because of this jet propelling force.

It is therefore an object of this invention to provide an internal combustion engine of the reciprocating piston type wherein a power stroke is developed during a four stroke cycle of operation.

It is another object of this invention to provide an internal combustion engine of the reciprocating piston type that is more efficient in developing usable power in order to be able to operate the engine more economically.

Still another object of this invention is to provide an internal combustion engine of the reciprocating piston type wherein the combustible fluid mixture is more completely burned during its operation in order to reduce unburned hydrocarbons and monoxides in the exhaust.

A further object of this invention is to provide an internal combustion engine which utilizes the reaction force of an escaping burning fluid mixture to assist during the power stroke in delivering power to its reciprocating piston.

It is also an object of this invention to provide an internal combustion engine of the reciprocating piston type with a piston having passageways therein to direct the combustible fluid mixture towards the center of the piston for more effective burning thereof.

A still further object of this invention is to provide an internal combustion engine of the reciprocating piston type which will conform to conventional forms of manufacture, and be of simple construction and efficient in operation, so as to provide an engine that will be economically feasible and inexpensive to make.

The novel features which are believed to be characteristic of the invention, both as to its organization and method of operation, together with further objects and advantages thereof, will be better understood from the following description considered with the accompanying drawings in which an embodiment of the invention is illustrated by way of example. It is to be expressly understood, however, that the drawings are for the purpose of illustration and description only, and are not intended as a definition of the limits of the invention.

DESCRIPTION OF THE PREFERRED EMBODIMENT

Figure 1:
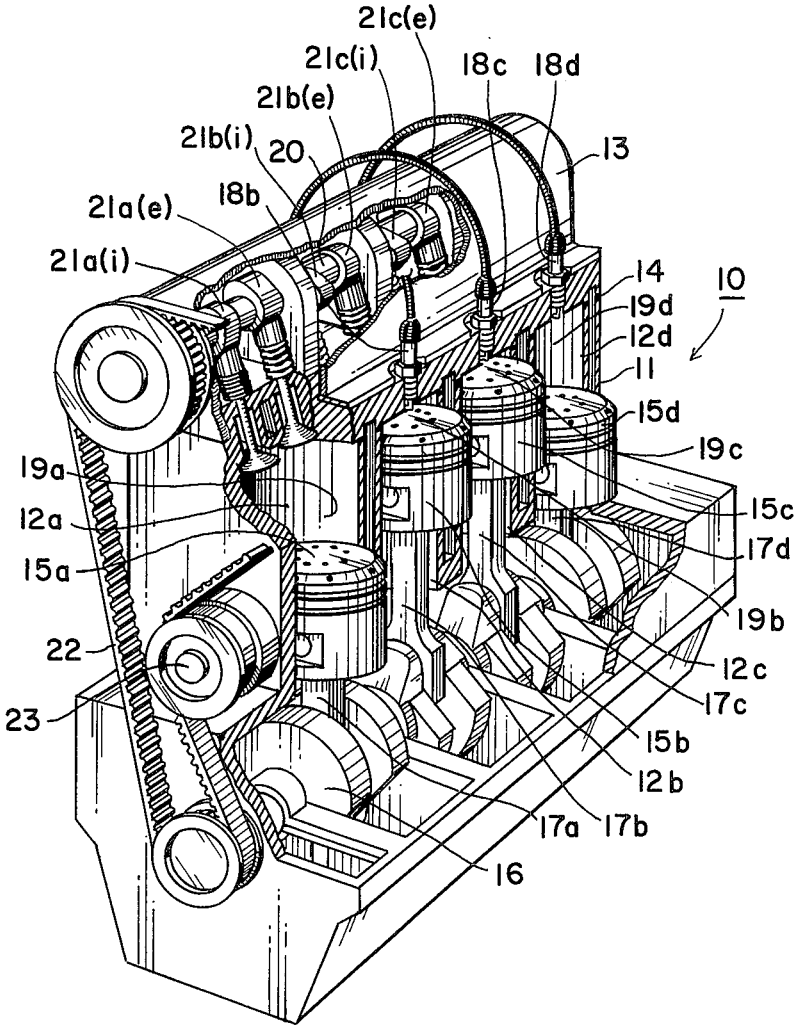
FIG. 1 is a perspective view of an internal combustion engine of this invention showing several cylinders in an engine block with a piston in each cylinder.

Referring now to the drawings, there is illustrated in FIG. 1 a perspective view of an internal combustion engine of this invention. Internal combustion engine 10 includes a cylinder block 11 forming a plurality of cylinders 12*a* to 12*d* therein. Generally, an even number of cylinders are used in the common internal combustion engines. In FIG. 1, four cylinders 12*a* to 12*d* are shown by way of example. A cylinder head 13 is bolted at the top of cylinder block 11 with a suitable gasket 14 therebetween to form a sealed connection. Pistons 15*a* to 15*d* are fitted inside cylinders 12*a* to 12*d* respectively. A crankshaft 16 is connected to cylinder block 11 and journalled to support members inside cylinder block 11 to be rotatable therein. Pistons 15*a* to 15*d* connect to crankshaft 16 by piston rods 17*a* to 17*d* respectively. Spark plugs 18*a* to 18*d* are seen extending into cylinders 12*a* to 12*d* respectively. As crankshaft 16 rotates, pistons 15*a* to 15*d* are caused to move and from variable chambers 19*a* to 19*d* in cylinders 12*a* to 12*d* respectively.

Camshaft 20 is seen to be rotatably connected in cylinder head 13. Camshaft 20 has a pair of cam lobes fixed thereon for each cylinder in cylinder block 11. Valve means are provided to open and close intake and exhaust ports to each cylinder. Such valve means may include valve lifters and springs operable by the rotational positions of the cam lobes on camshaft 20 to move associated valves in order to open and close the intake and exhaust ports of each cylinder. In FIG. 1, cam lobes 21*a*(*i*) and 21*a*(*e*) operate with the associated valves of cylinder 12*a* to respectively open and close intake and exahust parts in cylinder 12*a*. Similarly, cam lobes 21*b*(*i*) and 21*b*(*e*) to cam lobes 21*d*(*i*) and 21*d*(*e*) operate with the valves associated with cylinders 12*b* to 12*d* respectively to open and close intake and exhaust ports in these cylinders.

A spur belt 22 is seen to connect crankshaft 16 to camshaft 20 as well as being connected to simultaneously rotate water pump 23. As crankshaft 16 rotates, it turns spur belt 22 to rotate camshaft 20 and operate its associated valve means. As camshaft 20 is rotated, it will selectively operate the valve means provided in the internal combustion engine to open and close the intake and exhaust ports for a four cycle of operation as hereinafter described. As there are four piston strokes to a complete period of operation in each cylinder in the described engine, two crankshaft revolutions are required for each camshaft revolution. Each of the pair of valves for each cylinder open an input and output port only once during a complete period of operation. Accordingly, camshaft 20 is to make one revolution while crankshaft 16 makes two revolutions. Spur belt 22 causes camshaft 20 to rotate at one half the rotational speed of crankshaft 16.

FIGS. 2 through 5 show schematic vertical section views of a piston 30 in a cylinder block 31 of a conventional internal combustion engine, in which the position of piston 30 is shown at the beginning of the intake, compression, power, and exhaust strokes of operation, respectively. Piston 30 has a solid top portion forming a piston head 30*a* with a downwardly extending skirt 30*b* being a hollow bottom portion. Between circumferential edge 32 of piston head 30*a* and skirt 30*b*, piston rings 33 fit in grooves on the side of piston head 30*a*. A crankshaft 34 is journalled to rotate in the direction of arrow 35 in bearings inside crankcase 36. Piston rod 37 is connected to crankshaft 36 and to piston 30 inside skirt 30*b* to move piston 30 along the walls and up and down cylinder 38. In cylinder head 39, intake valve 40 and exhaust valve 41 are fitted to selectively open and close the round openings of intake port 42 and exhaust port 43 respectively. A spark plug 44 connected to an electrical power source provides means for igniting a combustible fluid mixture that exists in chamber 45.

Referring again to FIG. 2, one cylinder of an internal combustion engine is seen in which its piston is at the beginning of the intake stroke of the four stroke cycle of operation. Piston 30 is descending in the direction of arrow 46 seen in this figure. Intake valve 40 is positioned by valve means to open intake port 42. At the beginning of the intake stroke, the valve means moves exhaust valve 41 to close exhaust port 43. As piston 30 descends, combustion chamber 45 increases in volume, and a combustible fluid mixture is drawn into chamber 45 by a fuel system that may include a carburetor or other such means. The intake stroke ends with intake valve 40 closing intake port 42, and piston 30 being at its lowest position in clylinder 38.

Figure 2:
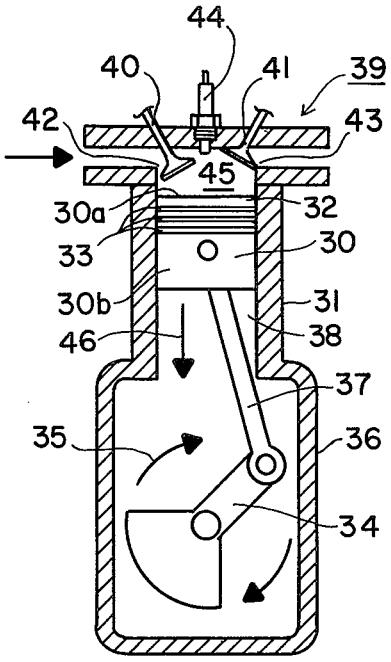
FIG. 2 PRIOR ART
FIG. 2 is a schematic vertical section view of a piston in a cylinder block of a conventional internal engine having the piston at the beginning of the intake stroke.
Figure 3:
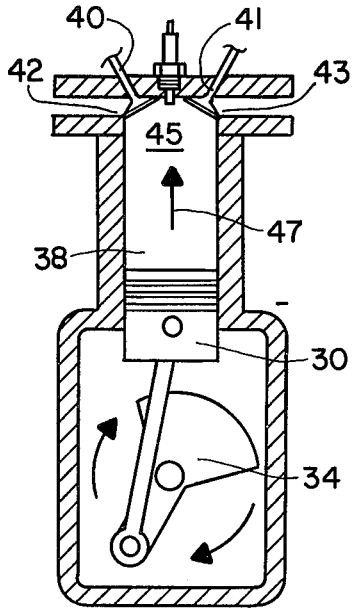
FIG. 3 PRIOR ART
FIG. 3 is a view similar to that in FIG. 2, but showing the piston at the beginning of the compression stroke.

FIG. 3 shows the cylinder of the internal combustion engine of FIG. 2 in which the piston is at the beginning of the compression stroke. Piston 30 ascends in the direction of arrow 47 as seen in the figure. Intake valve 40 and exhaust valve 41 continue to keep both intake port 42 and exhaust port 43 closed. As piston 30 ascends, combustion chamber 45 decreases in volume as the fluid mixture is compressed in preparation for the following power stroke.

Figure 4:
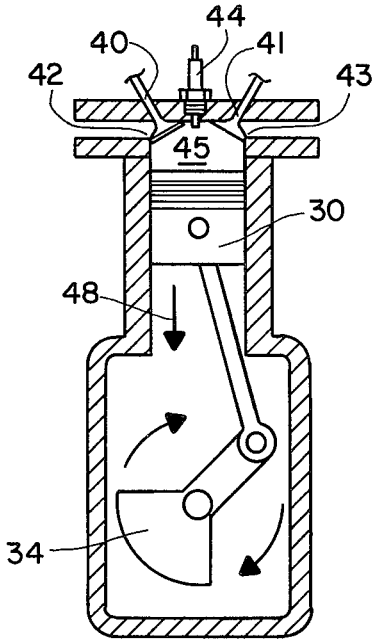
FIG. 4 PRIOR ART
FIG. 4 is a view similar to that in FIG. 2, but showing the piston at the beginning of the power stroke.

The start of the power stroke of the conventional internal combustion engine is shown in FIG. 4. Now, the fluid mixture in chamber 45 is ignited by spark plug 44. As during the compression stroke, intake valve 40 and exhaust valve 41 continue to keep intake port 42 and exhaust port 43 closed. As the compressed mixture burns, high pressure is created in chamber 45 pushing piston 30 down in the direction of arrow 48 to rotate crankshaft 34.

Figure 5:
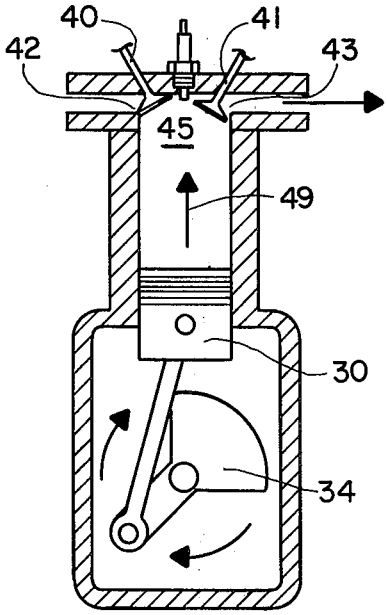
FIG. 5 PRIOR ART
FIG. 5 is a view similar to that in FIG. 2, but showing the piston at the beginning of the exhaust stroke.

The last stroke is the exhaust stroke in which piston 30 ascends in the direction or arrow 49 seen in FIG. 5. Intake port 42 remains closed and exhaust port 43 is open during this exhaust stroke. As piston 30 moves in the direction of arrow 49, it pushes the burned gases out of chamber 45 of cylinder 38. At the end of the exhaust stroke, intake valve 40 is caused to open intake port 42. Thereupon, the intake stroke of this internal combustion engine starts again to bring another fluid mixture into chamber 45 for the intake stroke operation of FIG. 2.

Figure 6:
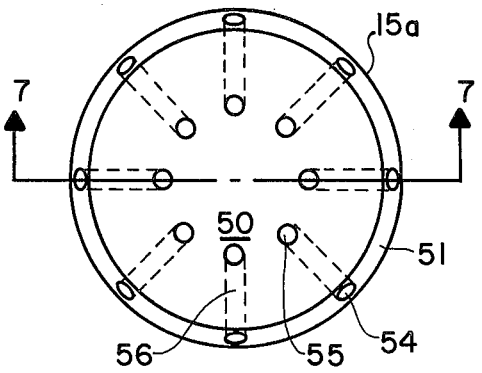
FIG. 6 is an enlarged top view of a piston used in the internal combustion engine shown in FIG. 1.
Figure 7:
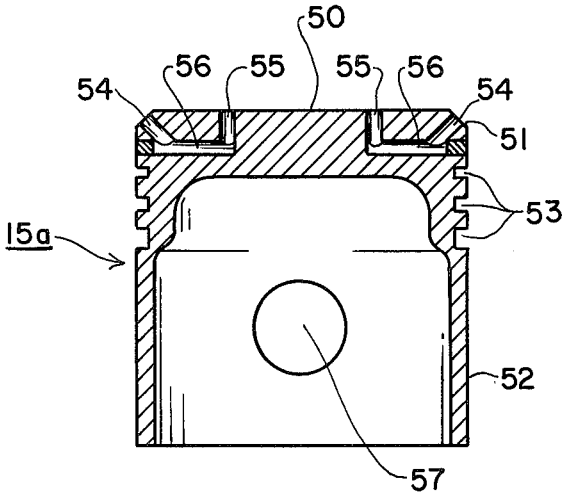
FIG. 7 is a cross-section view of the piston of this invention as seen along lines 7—7 of FIG. 6.

The internal combustion engine of this invention is constructed as the conventional engine shown in FIGS. 2 to 5, except for changes in the design of the piston and for changes in the design of the cam lobes of its camshaft, which will now be more particularly described. FIGS. 6 and 7 are enlarged top and side views of piston 15*a* seen in FIG. 1. As all piston are identical in construction, the description of piston 15*a* will be applicable to the other piston in this internal combustion engine of this invention.

Piston 15*a* includes a piston head or top portion 50 having a circular cross section with a circumferential beveled edge 51 on the top thereof. A skirt 52 extends away from piston head 51. Piston ring grooves 53 are provided around the piston near top portion of skirt 52 to receive piston rings. Equally spaced around the circumferential edge 51 of piston 15*a* are seen eight inlet openings 55. Passageways 56 inside piston head 50 extend from inlets 54 toward outlets 55. A pin 57 is provided to hold a piston rod which in turn is connected to crankshaft 16 as seen in FIG. 1.

The addition of passageways inside piston head 50 that extend from inlet openings 54 towards outlet openings 55 is the change in the design of the piston used in the internal combustion engine of this invention over that of the prior art. The other change in the construction design is that of the shape of the cam lobe on the camshaft. The shape of the cam lobe is designed to operate the valve means to open the exhaust port during the power stroke, e.g. half way, and then to keep the exhaust port open until the end of the exhaust stroke. These design changes in the construction are effective to change the operation of the internal combustion engine of this invention only during the power stroke. The operation of the combustion engine of this invention during the intake, compression, and exhaust strokes of operation are the same as that for the conventional four stroke cycle engine which was described and illustrated in FIGS. 2, 3, and 5 above.

Figure 8:
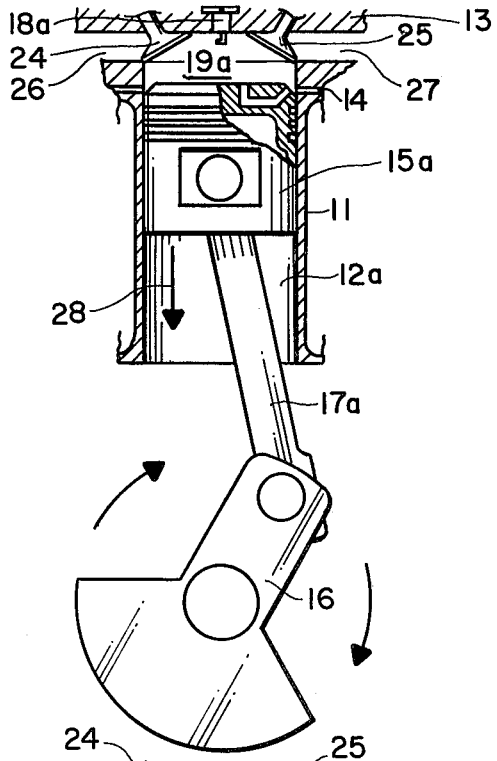
FIG. 8 is an enlarged section view of the piston in the cylinder block seen in FIG. 1 as seen substantially along lines 8—8 of FIG. 1, but showing the piston at the beginning of the first phase of the power stroke.
Figure 9:
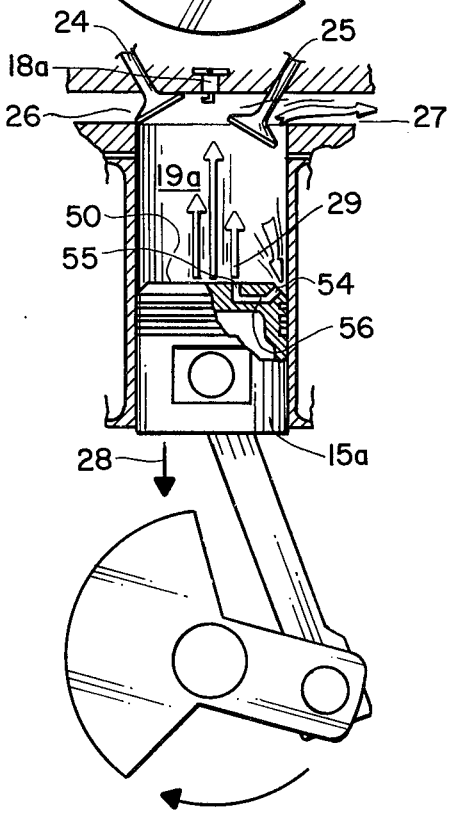
FIG. 9 is a view similar to that in FIG. 8, but showing the piston at the beginning of the second phase of the power stroke.

During the power stroke of operation, the engine of this invention develops a power stroke divided into two phases, which is illustrated in FIGS. 8 and 9. Prior to the power stroke, a combustible fluid mixture had been introduce into chamber 19*a* during the intake stroke, which had been compressed during the compression stroke, as in the conventional internal combustion engine. At the end of the compression stroke, intake valve 24 and exhaust valve 25 are not engaged by cam lobes 21*a*(*i*) and 21*a*(*e*) respectively, so that these valves are positioned to close intake port 26 and exhaust port 27 respectively, as seen in FIG. 8. At the start of the power stroke, spark plug 18*a* is fired to ignite the combustible fluid mixture in chamber 19*a*. As a result, a high pressure is developed by the burning fluid mixture thereby pushing piston 15*a* down in the direction of arrow 28. The first phase of the power stroke has now begun.

During the power stroke, exhaust valve 25 is caused to open exhaust port 27 as seen in FIG. 9 to start the second phase of the power stroke. In order to open exhaust port 27, the shape of cam lobe 21*a*(*e*) is extended to cause the valve means to move exhaust valve 25 to open exhaust port 27 during the power stroke, e.g. about half way. At this time the burning fluid mixture in chamber 19*a* will continue to burn. Some of the fluid mixture will flow into inlets 54 through passageways 56 and out of outlets 55.

As the walls of the cylinders are cooled, e.g. by circulating water, it will be realized that the hottest temperatures are near the center of piston head 50. Accordingly, some of the fluid mixture will flow into inlets 54 through passageways 56 and out of outlets 55. Upon exiting outlets 55, the fluid mixture will form an escaping column 29 of combustible fluid mixture extending from the center of piston head 50 towards exhaust port 27. As the temperatures are hottest at the center of piston head 50, a more complete burning of the fluid mixture will be obtained. Now, another type of force will be exerted on piston 15*a* to continue to push it down in the direction of arrow 28. This force is the reaction force of the escaping column of the burning fluid mixture.

The exhaust stroke then follows the power stroke. At the completion of its second phase, intake valve 26 remains closed and exhaust valve remains open, during the exhaust stroke. During this period of time, the fluid mixture in chamber 19*a* has been so completely burned that any reaction force of the escaping gases is then negligible. Thereafter, the cycles of operation as above described are repeated.

Having described the invention, what is claimed as new is:

1. An internal combustion engine for burning a combustible fluid mixture, said engine including:
   - means for forming a cylinder with an intake and exhaust port; a piston in the cylinder having a piston head with a circumferential edge,
     - said piston being formed with a plurality of passageways inside the piston head extending from inlets around the circumferential edge towards outlets around the center of the piston head;
   - a rotatable crankshaft connected to move the piston back and forth in a reciprocating motion to form a variable volume combustible chamber in the cylinder; and
   - a rotatable camshaft having valve means for selectively opening and closing the intake and exhaust ports,
     - said camshaft being operably connected to the crankshaft to develop a power stroke for the piston during a four stroke cycle of operation, and
     - said valve means operating to open the exhaust port before the end of the power stroke to divide the power stroke into a first phase and a second phase,
     - wherein during the power stroke of the four stroke cycle of operation, the valve means of the rotatable camshaft keep closed the exhaust port during a first phase portion of the power stroke, and opens the exhaust port during a second phase portion of the power stroke to allow the combustible fluid mixture to flow from the combustible chamber through the inlets to the passageways to form an escaping column of the combustible fluid mixture extending from the center of the piston head from said outlets towards the exhaust port, said escaping column of combustible fluid mixture developing a reaction force means on the piston head to continue to move the piston during the power stroke.

2. The internal combustion engine defined in claim 1 wherein the inlets to the passageways are equally spaced around the circumferential edge of the piston, the outlets of the passageways are equally spaced around the center of the piston head, and the passageways extend radially inside the piston head.

3. The internal combustion engine defined in claim 1 wherein the radial distances from the center of the piston towards the outlets of the passageways are equal, the length of the radial distances is equal to the length of the passageways, and the first phase of the power stroke of the piston is equal to the second phase of the power stroke of the piston.

4. An internal combustion engine for burning a combustible fluid mixture during a power stroke of a four stroke cycle of operation, said engine including:

a cylinder block with a plurality of cylinders therein;

a cylinder head connected to the cylinder block with an intake and exhaust port associated with each cylinder, an intake and an exhaust valve for each cylinder;

a piston in each cylinder, said piston having a piston head with a circumferential edge, and being formed with a plurality of passageways inside the piston head extending from inlets around the circumferential edge towards outlets around the center of the piston head;

a rotatable crankshaft connected to move each piston back and forth in a reciprocating motion to form a variable volume combustible chamber in its cylinder; and a rotatable camshaft being operably connected to the crankshaft and having valve means for selectively opening and closing the intake and exhaust ports, said valve means operating to open the exhaust ports before the end of the power stroke of each piston to divide the power stroke into a first phase and a second phase, wherein during the power stroke of each piston the fluid mixture in its chamber is caused to flow from the combustible chamber through the passageways from the inlets and out the outlets in order to form an escaping column of the combustible fluid mixture extending from the center of each piston head towards the exhaust port of the piston, while its exhaust port is open, said escaping column of combustible fluid mixture developing a reaction force means on the piston head to continue to move the piston during the power stroke.

5. The internal combustion engine defined in claim 4 wherein the inlets to the passageways are equally spaced around the circumferential edge of the pistons, the outlets of the passageways are equally spaced around the center of the piston heads, and the passageways extend radially inside the piston heads.

6. The internal combustion engine defined in claim 4 wherein the radial distances from the center of each piston towards the outlets of the passageways are equal, the length of the radial distances is equal to the length of the passageways, and the first phase of the power stroke of each piston is equal to the second phase of the power stroke of the piston.

7. In an internal combustion engine for burning a combustible fluid mixture, said engine having a cylinder block with a plurality of cylinders formed therein, a cylinder head connected to the cylinder block with an intake and exhaust port associated with each cylinder, an intake and exhaust valve for each cylinder, a piston in each cylinder, a rotatable crankshaft having a piston rod connected to each piston to move the piston in a reciprocating motion to form a variable volume combustible chamber in each cylinder, and a rotatable camshaft having actuating means for the intake and exhaust valves to selectively open and close each intake and exhaust port, said camshaft being operably connected to the crankshaft to develop a power stroke for the piston in each cylinder during a four stroke cycle of operation, the improvement wherein:

the piston having a piston head with a circumferential edge is formed with a plurality of passageways inside the piston head extending from spaced inlets around the circumferential edge towards spaced outlets around the center of the piston head; and the actuating means of the camshaft is operable to open the exhaust port before the end of the power stroke of the piston to divide the power stroke into a first phase and a second phase, wherein the fluid mixture in the combustible chamber is caused to flow from the combustible chamber during the power stroke through the passageways from the inlets and out the outlets, and to form an escaping column of the combustible fluid mixture extending from the center of the piston head towards the exhaust port while the exhaust port is open during the power stroke, said escaping column of combustible fluid mixture developing a reaction force means on the piston head to continue to move the piston during the power stroke.

8. The internal combustion engine defined in claim 7 wherein the inlets to the passageways are equally spaced around the circumferential edge of the pistons, the outlets of the passageways are equally spaced around the center of the piston heads, and the passageways extend radially inside the piston heads.

9. The internal combustion engine defined in claim 7 wherein the radial distances from the center of each piston towards the outlets of the passageways are equal, the length of the radial distances is equal to the length of the passageways, and the first phase of the power stroke of each piston is equal to the second phase of the power stroke of the piston.

10. In an internal combustion engine for burning a combustible fluid mixture, said engine having a cylinder block with a cylinder formed therein, a cylinder head connected to the cylinder block with an intake and exhaust port associated with the cylinder, an intake and exhaust valve for the cylinder, a piston in the cylinder, a rotatable crankshaft having a piston rod connected to the piston to move the piston in a reciprocating motion to form a variable volume combustible chamber in the cylinder, and a rotatable camshaft having actuating means for the intake and exhaust valves to selectively open and close the intake and exhaust port, said camshaft being operably connected to the crankshaft to develop a power stroke for the piston in the cylinder during a four stroke cycle of operation, the improvement wherein:

the piston having a piston head with a circumferential edge is formed with a plurality of passageways inside the piston head extending from spaced inlets around the circumferential edge towards spaced outlets near the center of the piston head; and the actuating means of the camshaft is operable to open the exhaust port during the power stroke of the piston to divide the power stroke into a first phase and a second phase, wherein during the power stroke the actuating means of the camshaft continues to close the exhaust port during a first phase portion of the power stroke, and opens the exhaust port during a second phase portion of the power stroke to allow the combustible fluid mixture to flow from the combustible chamber through the passageways to form an escaping column of the combustible fluid mixture extending from the piston towards the exhaust port, said escaping column of combustible fluid mixture developing a reaction force means on the piston head to continue to move the piston during the power stroke.

11. The internal combustion engine defined in claim 10 wherein the inlets to the passageways are equally spaced around the circumferential edge of the piston, the outlets of the passageways are equally spaced around the center of the piston head, and the passageways extend radially inside the piston head.

12. The internal combustion engine defined in claim 10 wherein the radial distances from the center of the piston towards the outlets of the passageways are equal, the length of the radial distances is equal to the length of the passageways, and the first phase of the power stroke of the piston is equal to the second phase of the power stroke of the piston.

* * * * *